US006969949B2

(12) United States Patent
Su et al.

(10) Patent No.: US 6,969,949 B2
(45) Date of Patent: Nov. 29, 2005

(54) PLASMA DISPLAY PANEL WITH SPEEDY GAS-CHARGE AND DISCHARGE STRUCTURE

(75) Inventors: Yao-Ching Su, Taoyuan (TW); Chung-Kuang Tsai, Hsinchu (TW); Yih-Jer Lin, Kaohsiung (TW)

(73) Assignee: AU Optronics Corp., Hsinchu (TW)

( * ) Notice: Subject to any disclaimer, the term of this patent is extended or adjusted under 35 U.S.C. 154(b) by 258 days.

(21) Appl. No.: 10/637,180

(22) Filed: Aug. 8, 2003

(65) Prior Publication Data

US 2004/0130266 A1 Jul. 8, 2004

(30) Foreign Application Priority Data

Jan. 7, 2003 (TW) ..... 92100277 A

(51) Int. Cl.[7] ..... H01J 17/49

(52) U.S. Cl. ..... 313/582; 313/292

(58) Field of Search ..... 313/582, 586, 313/634, 252, 292

(56) References Cited

FOREIGN PATENT DOCUMENTS

TW 451240 8/2001

*Primary Examiner*—Vip Patel

(57) ABSTRACT

A plasma display panel comprises a plurality of red, green and blue display units arranged on a substrate, so as to form plural red, green, blue display unit channels whose directions are aligned towards a ventilation hole located on the substrate, for facilitating gas charge or discharge in a good speed.

8 Claims, 3 Drawing Sheets

PLASMA DISPLAY PANEL WITH SPEEDY GAS-CHARGE AND DISCHARGE STRUCTURE

This application claims the benefit of Taiwan application Serial No. 92100277, filed Jan. 07, 2003.

BACKGROUND OF THE INVENTION

1. Field of the Invention

The invention relates in general to a plasma display panel, and more particularly to a plasma display panel with speedy gas-charge and discharge structure.

2. Description of the Related Art

With the advantageous features of larger screen size, wider angle of view, higher resolution, and full-color image display, the plasma display panel (PDP) whose display effect is much superior to that of a cathode ray tube display (CRT display) has attracted the public interest in recent years.

Referring to FIG. 1, a three-dimensional diagram for a conventional plasma display panel is illustrated. Plasma display panel is composed of a front substrate 102 and a back substrate 108, wherein plural sustaining electrodes X and plural scanning electrodes Y are alternatively arranged on the front glass substrate 102. A plurality of transparent electrodes (not shown in the diagram) can be formed and defined prior to the formation of the sustaining electrodes X and scanning electrodes Y, wherein the defined patterns of the transparent electrodes depend on the different application, and are not to be described hereinafter. The sustaining electrodes X and scanning electrodes Y are covered by a dielectric layer 104. The dielectric layer 104, covered by a protection layer 106 made of magnesium oxide, is used to protect the sustaining electrodes X, the scanning electrodes Y and the dielectric layer 104. Besides, plural data electrodes A are located on the back substrate 108 in parallel and covered by the dielectric layer 116. The data electrodes A are allocated in a direction orthogonal to the direction of the sustaining electrodes X and the scanning electrodes Y. The Barrier ribs 112 are formed on the back substrate 108 parallel to the direction of the data electrodes A, and a fluorescent layer 110 is coated on the interval between every two adjacent barrier ribs 112.

The cavity between the front substrate 102 and the back substrate 108 is a discharge space filled with a discharge gas, a mixture of neon gas and xenon gas. A sustaining electrode X and a scanning electrode Y 108 located on the front substrate 102 together with their corresponding data electrode A located on the back substrate 108 define a display unit. In doing so, a plurality of sustaining electrodes X and scanning electrodes Y together with a plurality of data electrodes A will define plural display units arranged in a matrix configuration on the plasma display panel. When being excited, the gas enclosed at the discharge space will emit ultra-velvet light. The fluorescent layer 110 will emit visible light after it absorbs the ultra-velvet light of specific wavelength.

The plural display units can be arranged on a plasma display panel in the form of horizontal or triangular configuration. Referring to FIG. 2, a schematic diagram illustrates the mutual relationship between the display units and the electrodes on a plasma display panel in the form of horizontal configuration. Display units of different colors can be obtained by coating the fluorescent layer with different colors between the adjacent ribs. As shown in FIG. 2, the data electrode A1 controls the red display units R1 and R2; the data electrode A2 controls the green display units G1 and G2; the data electrode A3 controls blue display units B1 and B2. To drive a display unit, first of all, all the display data located within an erase period need to be erased. Then, within an address period, sequentially scan the scanning electrodes Y1 and Y2; select the display units to be lit by means of charging the data electrodes A1~A3. Following that, within a sustain discharge period, an alternating voltage is provided between the adjacent sustaining electrode X1 and scanning electrode Y1, and also between the sustaining electrode X2 and the scanning electrode Y2; thereby, the selected display units will be lit continuously.

Referring to FIG. 3, a schematic diagram illustrating the mutual relationship between the display units and various electrodes allocated on a plasma display panel in the form of triangular configuration is shown. The triangular configuration for plural display units is achieved by arrangement of the barrier ribs 302. Take two adjacent and alternately arranged display units—green display unit G2 and red display unit R2 for example. The green display unit G2 is controlled by the data electrode A2 and the scanning electrode Y1, while the red display unit R3 is controlled by the data electrode A1 and the scanning electrode Y1. When the scanning electrode Y1 is scanned, the scanning electrodes A1 and A2 will lighten the green display unit G2 and the red display unit R3, respectively.

As disclosed above, the discharge space between the front substrate 102 and the back substrate 108 is filled with a discharge gas that is a mixture of neon and xenon. Before charging the discharge gas, the discharge space needs to be fully vacuumed first to assure the purity of discharge gas. However, neither the conventional display unit of horizontal configuration nor that of triangular configuration can be vacuumed or ventilated in a good speed.

SUMMARY OF THE INVENTION

It is therefore an object of the invention to provide a plasma display panel with speedy gas-charge and discharge structure by setting the channel direction of the display unit towards a ventilation hole on the substrate.

According to the invention, a plasma display panel comprising plural red display units on a substrate forming plural red display unit channels, plural green display units on the substrate forming plural green display unit channels, plural blue display units on the substrate forming plural red display unit channels is provided. Of which, the directions of the red, green and blue display units are aligned towards a ventilation hole located on the substrate.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
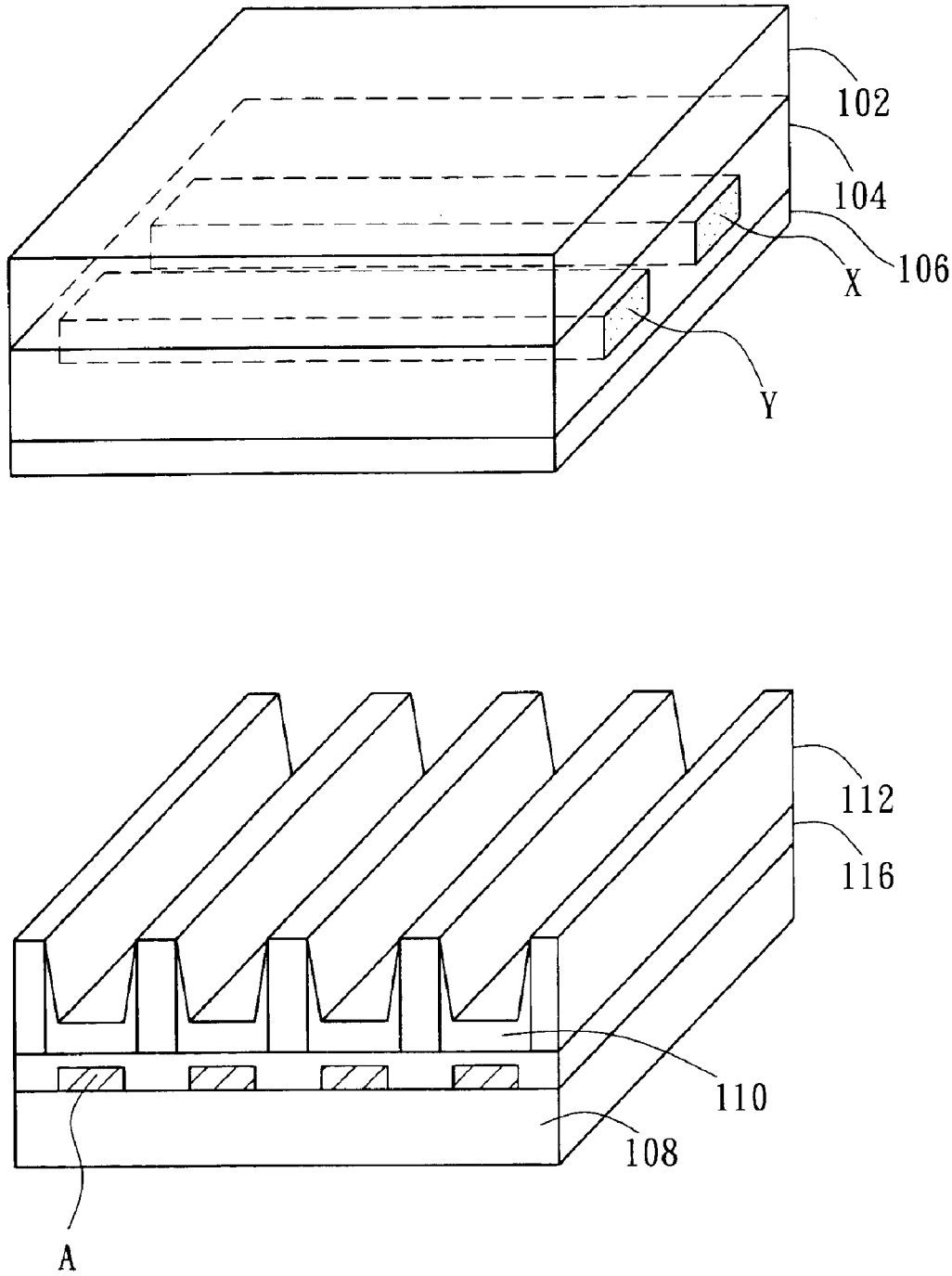
FIG. 1 is a three-dimensional diagram for a conventional plasma display panel.
Figure 2:
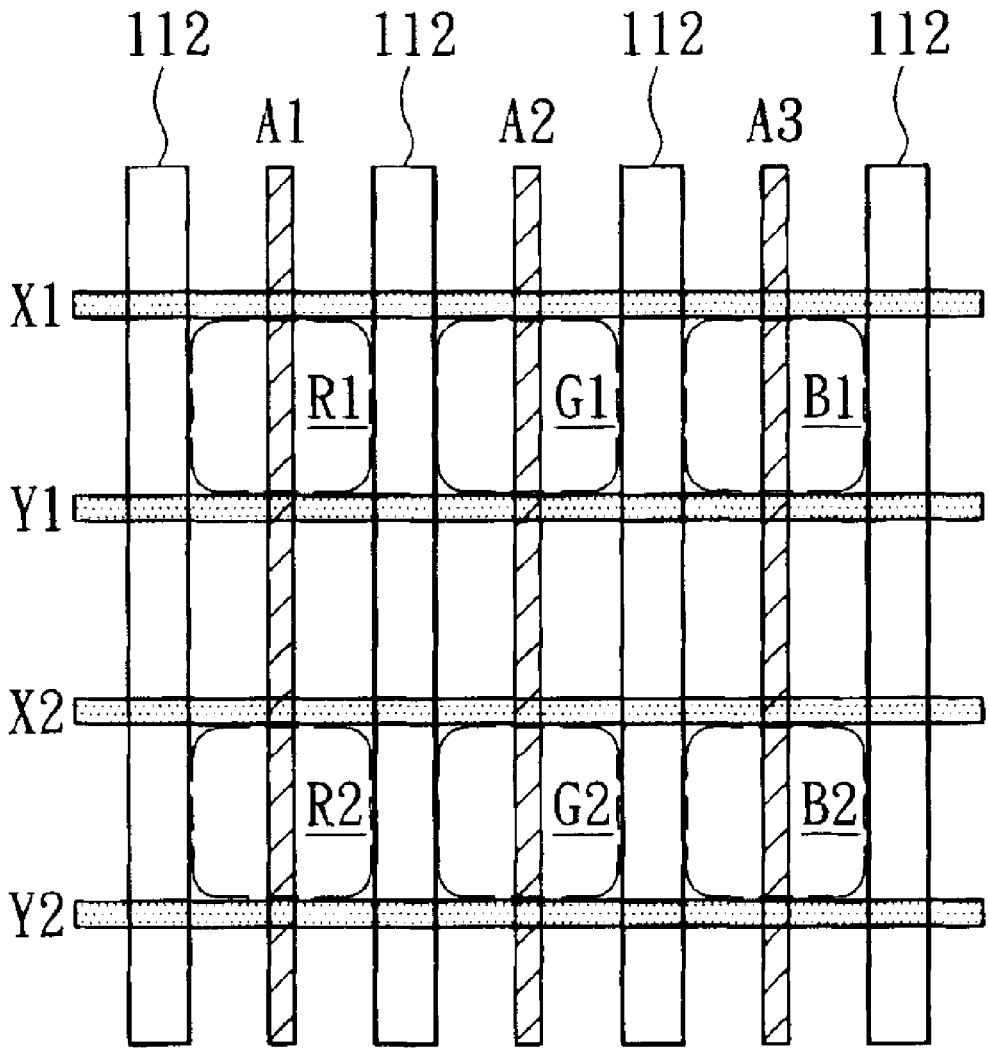
FIG. 2 is a schematic diagram illustrating the mutual relationship between the display units and the electrodes on a plasma display panel in the form of horizontal configuration.
Figure 3:
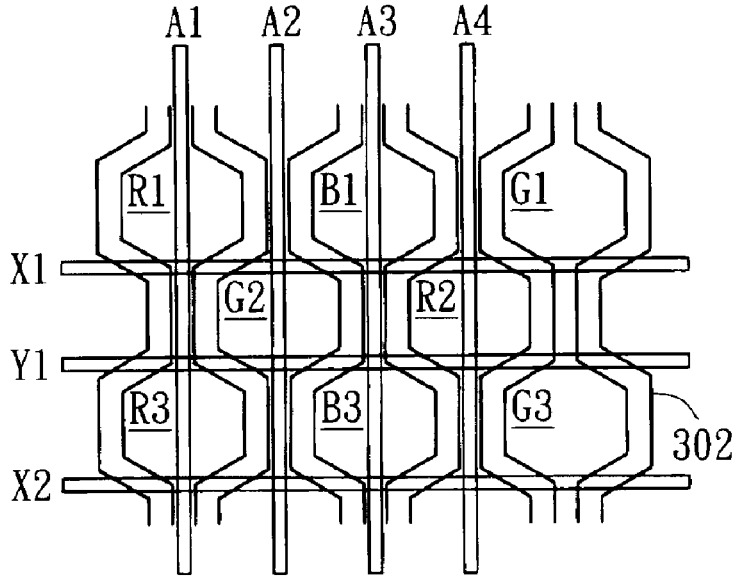
FIG. 3 is a schematic diagram illustrating the mutual relationship between the display units and various electrodes on a plasma display panel in the form of triangular configuration.
Figure 4:
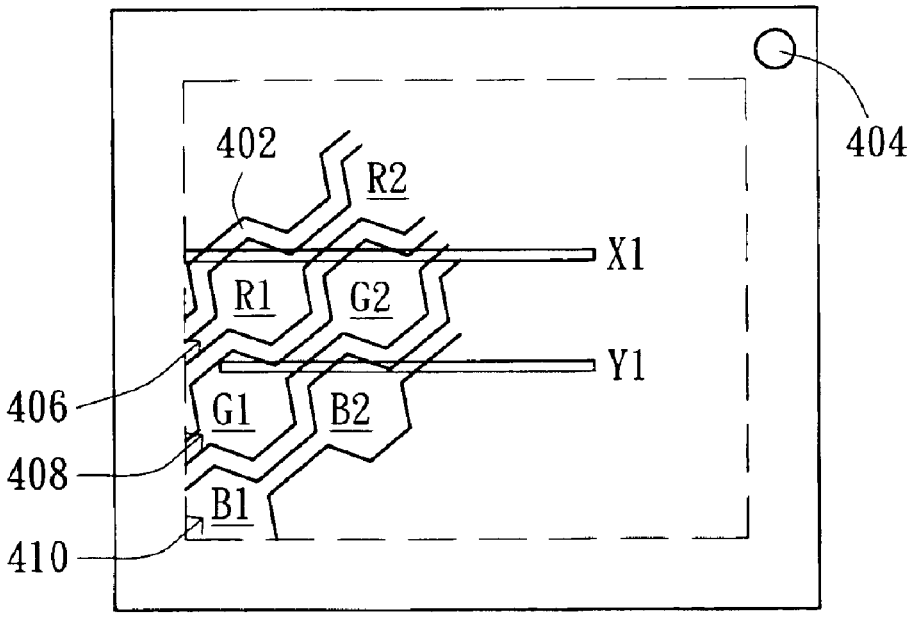
FIG. 4 is a schematic diagram illustrating the mutual relationship between the display units and the ventilation hole according to a preferred embodiment of the invention.

Referring to FIG. 4, a schematic diagram illustrating the mutual relationship between the display units and the ventilation hole according to a preferred embodiment of the invention. The plural display units are arranged in the form of triangular configuration (i.e. in a delta form), and partitioned by the barrier ribs 402. Take blue display unit B1 and green display unit G1 for example. Blue display unit B1 is controlled by the data electrode A3 and the scanning electrode Y1, while green display unit is controlled by the data electrode A1 and the scanning electrode Y1. When the scanning electrode Y1 is charged, the green display unit G1 and blue display unit B1 can be lighten by selecting the scanning electrodes A1 and A3, respectively. Display units of the same color will form a channel. For example, the red display units R1 and R2 form a red display unit channel (R channel) 406; the green display units G1 and G2 form a green display unit channel (G channel) 408; the blue display units B1 and B2 form a blue display unit channel (B channel) 410. When the plasma display panel is manufactured according to the invention, the R channel 406, G channel 408, and B channel 410 can be aligned towards the ventilation hole 404 to facilitate speedy charging or discharging (vacuum) of gas.

Although of the matrix of display units disclosed above is in a form of triangular configuration and the barrier ribs is in a form of dumbbell, it is to be understood that the invention is not limited thereto. According to the present invention, the display units can be arranged in a horizontal configuration, and the shape of the barrier ribs can be square or other shapes. As long as all of the R channel, the G channel, and the B channel formed by the red, the green, and the blue display units respectively are aligned towards the ventilation hole of the plasma display panel, the purpose of speed gas charge and discharge can be achieved. Moreover, it is usually one ventilation hole in the plasma display panel, however, it could be more than one, depending on the practical applications.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A plasma display panel (PDP), comprising:

a matrix of display units arranged on a substrate, and the directions of a plurality of channels formed by the display units towards a ventilation hole located on the substrate.

2. The plasma display panel according to claim 1, wherein the display units are arranged on the substrate in a form of triangular configuration.

3. The plasma display panel according to claim 1, wherein the display units are partitioned by a plurality of barrier ribs.

4. The plasma display panel according to claim 1, wherein the display units comprise a plurality of red display units, a plurality of green display units, and a plurality of blue display units.

5. The plasma display panel according to claim 4, wherein the red display units, the green display units and the blue display units form a plurality of red display unit channels, green display unit channels and blue display unit channels, respectively.

6. A plasma display panel (PDP), comprising:

a plurality of red display units, arranged on a substrate in arrays and forming plural red display unit channels, directions of the red display unit channels towards a ventilation hole located on the substrate;

a plurality of green display units, arranged on the substrate in arrays and forming plural green display unit channels, directions of the green display units towards the ventilation hole located on the substrate; and a plurality of blue display units, arranged on the substrate in arrays and forming plural blue display unit channels, directions of the blue display units towards the ventilation hole located on the substrate.

7. The plasma display panel according to claim 6, wherein the red, green and blue display units are arranged on the substrate in a form of triangular configuration.

8. The plasma display panel according to claim 6, wherein the red, green and blue display units are partitioned using a plurality of barrier ribs.

* * * * *